United States Patent [19]

Guertin

[11] 4,245,681

[45] Jan. 20, 1981

[54] AUTOMATIC SHUT-OFF NOZZLE HAVING AN INDEPENDENT SENSOR ARRANGEMENT FOR SENSING THE PRESENCE OF LIQUID IN VAPOR RETURN MEANS OF THE NOZZLE

[75] Inventor: Robert W. Guertin, Cincinnati, Ohio

[73] Assignee: Dover Corporation, New York, N.Y.

[21] Appl. No.: 9,385

[22] Filed: Feb. 2, 1979

[51] Int. Cl.[3] ..... B65B 3/26; B67C 3/26

[52] U.S. Cl. ..... 141/206; 141/225; 141/302

[58] Field of Search ..... 141/192-229, 141/1, 44, 45, 46, 52, 59, 93, 97, 290, 301, 302, 346, 392

[56] References Cited

U.S. PATENT DOCUMENTS 4,049,029 9/1977 Hansel ..... 141/206

*Primary Examiner*—Houston S. Bell, Jr.

*Attorney, Agent, or Firm*—Kinney and Schenk

[57] ABSTRACT

Liquid flow through an automatic shut-off nozzle is automatically stopped when the presence of liquid at a predetermined location in the vapor return means is sensed by an independent sensor arrangement. The automatic shut-off nozzle also stops flow in response to the tank being filled to a predetermined level with liquid or the pressure in the tank exceeding a predetermined pressure.

22 Claims, 5 Drawing Figures

AUTOMATIC SHUT-OFF NOZZLE HAVING AN INDEPENDENT SENSOR ARRANGEMENT FOR SENSING THE PRESENCE OF LIQUID IN VAPOR RETURN MEANS OF THE NOZZLE

When filling a vehicle tank with gasoline through a dispensing nozzle, vapors from the gasoline within the tank can be prevented from escaping through the fill pipe opening in which the spout of the nozzle is inserted by sealing the fill pipe opening. Thus, the escape of the gasoline vapors into the atmosphere is prevented so that pollution of the atmosphere is decreased. The vapors within the tank can be recovered through vapor recovery equipment utilized in conjunction with the nozzle.

However, the level of the gasoline within the vehicle tank being filled cannot be viewed because of the sealing of the fill pipe opening. Therefore, it is necessary for there to be automatic shut off of the supply of gasoline with a nozzle having a vapor recovery arrangement.

The automatic shut-off mechanism, which automatically stops the supply of gasoline to the vehicle tank, depends upon the level of the liquid in the tank reaching a predetermined level at which it blocks a vacuum passage opening in the nozzle spout to cause activation of release means to move the main poppet valve, which is controlling liquid flow through the nozzle body, to its closed position. However, because of the angles of the fill pipes of certain vehicles, the spout may be so disposed within the fill pipe that the vacuum passage opening in the nozzle spout cannot be blocked by the level of the gasoline in the vehicle tank prior to the gasoline flowing through vapor return means in the nozzle body.

Because of the vapor return seal sealing the fill pipe opening, the attendant cannot see the pitch of the nozzle spout within the fill pipe. Thus, the attendant cannot position the nozzle spout within the fill pipe so that the vacuum passage opening in the nozzle spout would be located so as to be blocked by the level of the gasoline in the tank prior to the gasoline in the tank escaping therefrom through the vapor return means in the nozzle body.

Accordingly, if the vacuum passage opening in the nozzle spout is not blocked by the level of the gasoline in the tank prior to the gasoline being able to flow through the vapor return means in the nozzle body, gasoline would be pumped through the fill pipe to the tank and then returned to the vapor recovery equipment through the vapor return means in the nozzle body. As a result, the customer would pay for gasoline not received since the pumping of gasoline is utilized to determine the quantity supplied to the customer.

One previously suggested arrangement for sensing the presence of liquid in vapor return means of an automatic shut-off nozzle is shown and described in the copending patent application of Robert W. Guertin et al for "Automatic Shut-Off Nozzle Having An Arrangement For Sensing The Presence Of Liquid In Vapor Return Means Of The Nozzle," Ser. No. 803,048, filed June 3, 1977 now U.S. Pat. No. 4,125,139 and assigned to the same assignee as the assignee of this application. In the aforesaid Guertin et al application, the stopping of the flow of liquid due to the presence of liquid in the vapor return means of the nozzle is accomplished by blocking the air flow between the tank, which is being filled, and the venturi means, which creates the partial vacuum in the vacuum chamber.

With the present invention, a separate and independent sensor arrangement is utilized while still enabling the stopping of the flow of liquid due to the pressure in the tank exceeding a predetermined pressure or liquid in the tank reaching a predetermined level. The present invention utilizes a separate venturi means and a separate vacuum chamber for responding to the sensing of the presence of liquid in the vapor return means. This independent and separate sensor arrangement activates the same release means for causing closing of the valve as is activated when the liquid in the tank reaches a predetermined level or the pressure in the tank exceeds a predetermined pressure.

An object of this invention is to provide an automatic shut-off nozzle having an arrangement capable of stopping flow automatically whenever liquid is at a predetermined location within the vapor return means of the nozzle.

Another object of this invention is to provide an automatic shut-off nozzle that automatically stops flow in response to any of the following conditions: the liquid level in the tank being filled reaching a predetermined level, the pressure in the tank exceeding a pedetermined pressure, or liquid being present at a predetermined position within the vapor return means of the nozzle.

A further object of this invention is to provide an automatic shut-off nozzle having one responsive means for sensing the presence of liquid in vapor means of the nozzle body and another responsive means for sensing the liquid level in the tank reaching a predetermined level or the pressure in the tank exceeding a predetermined pressure.

Other objects, uses, and advantages of this invention are apparent upon a reading of this description which proceeds with reference to the drawings forming part thereof and wherein.

Figure 1:
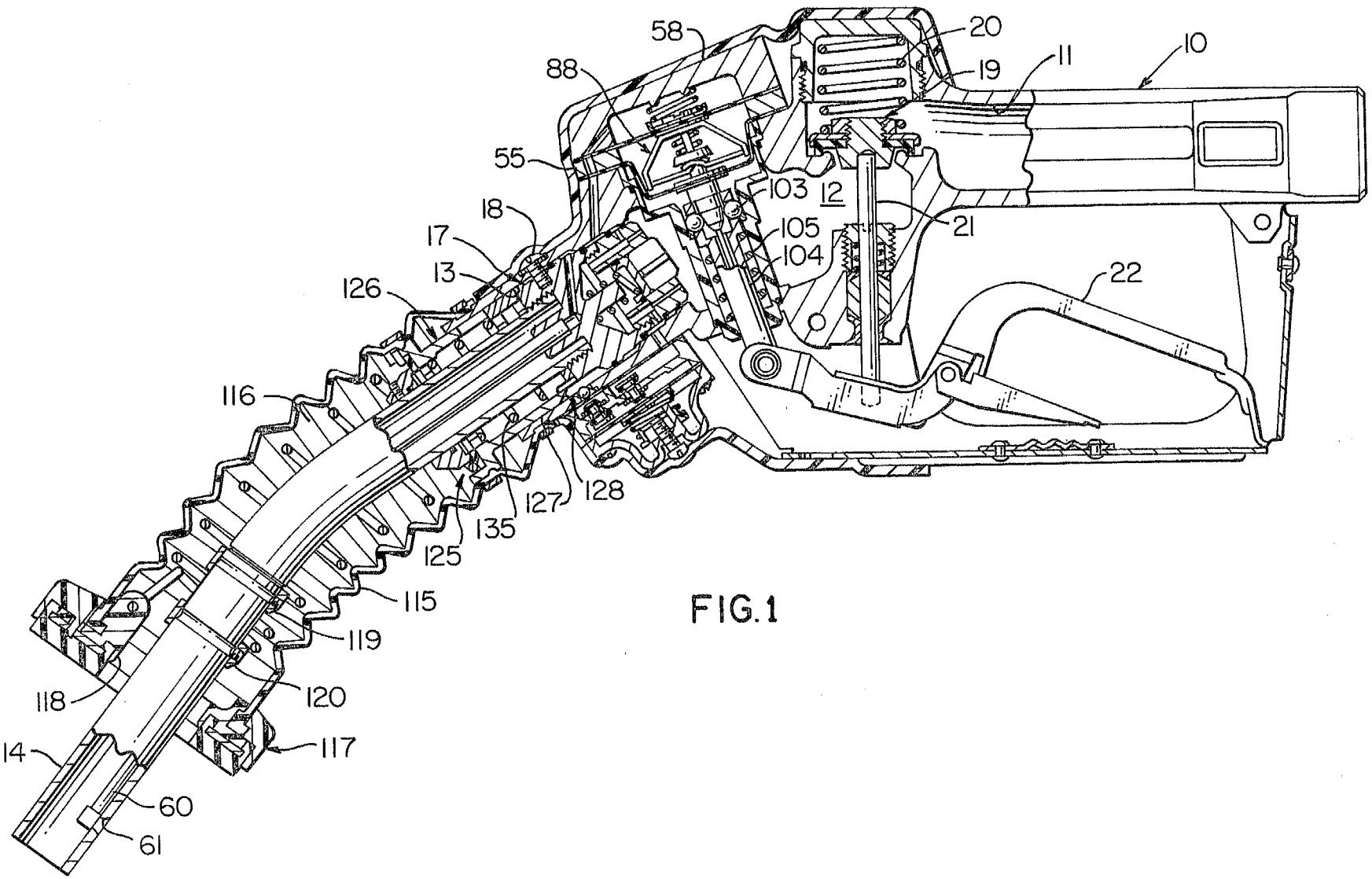
FIG. 1 is a sectional view, partly in elevation, of a nozzle having the sensing arrangement of the present invention.

Referring to the drawings and particularly FIG. 1, there is shown a nozzle body 10 having an inlet 11 to which a hose is connected to supply liquid such as gasoline, for example, to a chamber 12 within the interior of the body 10. The body 10 has an outlet 13 with which a spout 14 communicates to receive liquid from the chamber 12 within the interior of the body 10.

Figure 2:
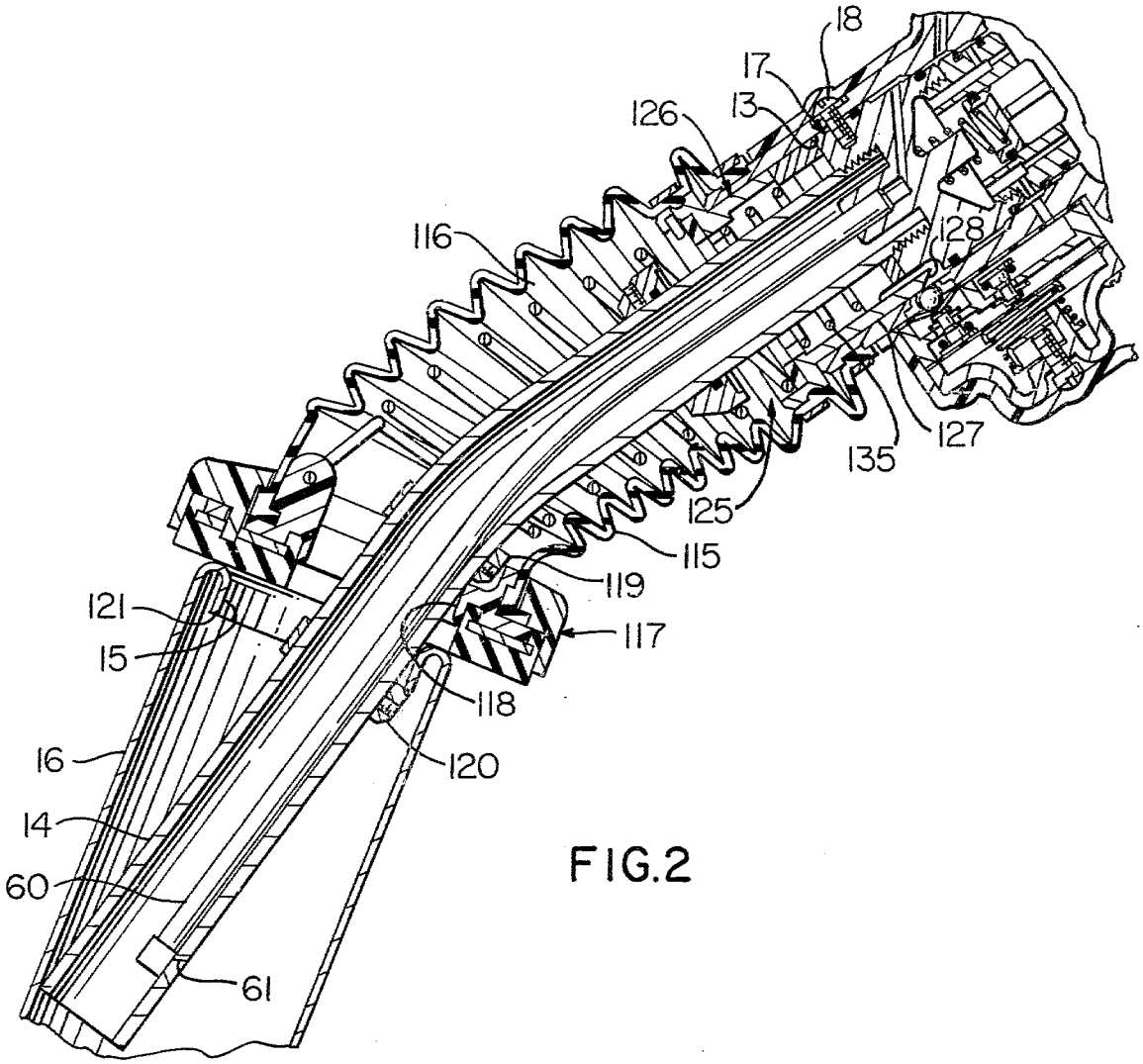
FIG. 2 is a fragmentary longitudinal sectional view of a portion of the nozzle of FIG. 1 and showing the spout of the nozzle of FIG. 1 in the fill pipe of the vehicle tank.

The spout 14, which is adapted to be inserted within an opening 15 (see FIG. 2) in a fill pipe 16 of a vehicle tank such as an automobile fuel tank, for example, has an end threaded in a spout adapter 17 (see FIG. 1). The spout adapter 17 is connected to the outlet 13 of the body 10 by a screw 18.

The body 10 has a first or main poppet valve 19 supported therein for control of the flow of liquid from the inlet 11 to the chamber 12 within the interior of the body 10 and from the chamber 12 to the spout 14. A spring 20 continously urges the poppet valve 19 to its closed position in which flow from the inlet 11 to the chamber 12 and the spout 14 is stopped or prevented.

A stem 21 is connected to the poppet valve 19 and has its lower portion extending exteriorly of the body 10. The valve stem 21, which is slidably disposed within the body 10, is moved by a manually operated lever or handle 22. The stem 21 passes through the body 10 in the same manner as described in U.S. Pat. No. 3,811,486 to Wood.

Figure 3:
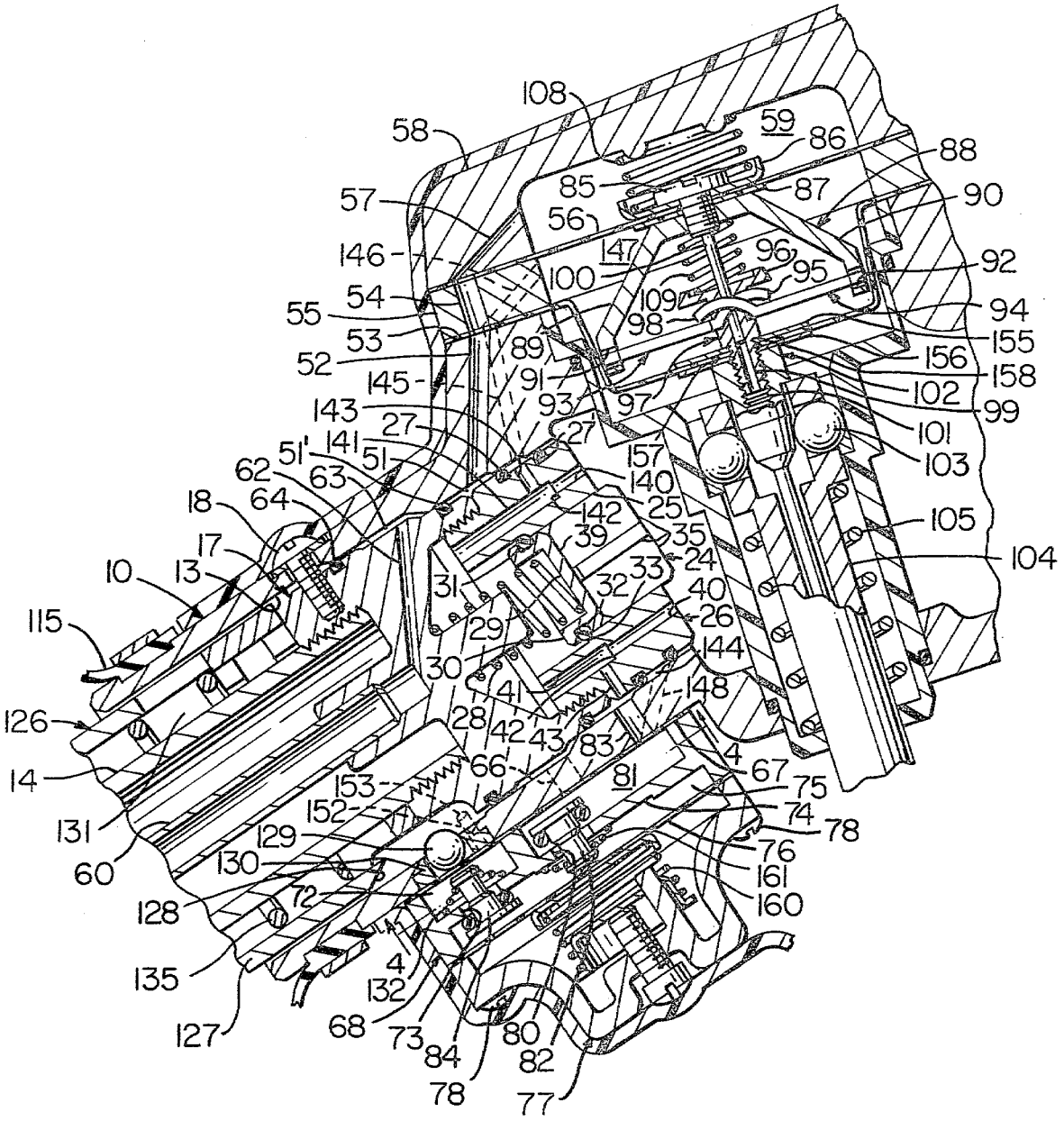
FIG. 3 is an enlarged fragmentary sectional view of a portion of the nozzle of FIG. 1 and showing the independent sensing arrangement of the present invention.

A by-pass or bleeder poppet valve 24 (see FIG. 3) is slidably mounted within a passage 25 in a seat ring 26. The seat ring 26 is secured to the spout adapter 17 by being threadedly connected thereto. Sealing rings 27 and 27' are disposed between the body 10 and the seat ring 26 to prevent leakage therebetween.

A spring 28, which has one end engaging a portion of the spout adapter 17 and its other end engaging a flat surface 29 of a cup-shaped element 30 of the by-pass valve 24, urges the by-pass valve 24 to its closed position in which an O-ring 31, which is carried in a groove 32 in the cup-shaped element 30 of the by-pass valve 24, engages an angled surface 33 of the seat ring 26 to allow the valve 24 to close the passage 25. Thus, only the pressure of liquid going from the inlet 11 (see FIG. 1) and past the main poppet valve 19 can overcome the spring 28 (see FIG. 3) and move the by-pass valve 24 to an open position in which the O-ring 31 no longer engages the surface 33 of the seat ring 26.

The cup-shaped element 30 of the by-pass valve 24 has four legs 35 (three shown) extending from a flat surfaces 39, which is parallel to the surface 29, thereof. The legs 35, which are equally angularly spaced from each other, cooperate with the wall of the passage 25 in the seat ring 26 to guide the sliding movement of the by-pass valve 24 in the passage 25.

The seat ring 26 has a first passage 40 having one end communicating with the chamber 12 within the interior of the body 10 and its other end communicating with one end of the second passage 41 in the seat ring 26. The other end of the second passage 41 communicates with the downstream sides of the seat ring 26 and the by-pass valve 24.

The first passage 40 has a smaller diameter than the second passage 41 to form a shoulder 42 at the junction of the first passage 40 and the second passage 41. The seat ring 26 has a third passage 43, which has its axis substantially perpendicular to the axis of the passages 40 and 41 and has a slightly smaller diameter than the first passage 40, communicating with the second passage 41 and an annular chamber 51, which is formed between the body 10, the spout adapter 17, the seat ring 26, the sealing ring 27, and a sealing ring 51'.

As the liquid flows through the first passage 40 and the second passage 41, a venturi effect is created in the third passage 43. This is because the increase in the cross sectional area of the second passage 41 compared with the cross sectional area of the first passage 40 produces an expansion of the liquid to reduce its velocity whereby air is drawn from the third passage 43 into the second passage 41. The third passage 43 communicates through the chamber 51, a passage 52 in the body 10, an opening in a first diaphragm 53, a passage 54 in a spacer 55, an opening in a second diaphragm 56, and a passage 57 in a cap 58 to a chamber 59, which is formed between the second diaphragm 56 and the cap 58.

The chamber 51 also communicates with a vacuum tube 60, which is connected with an opening 61 (see FIG. 1) in the spout 14 adjacent the discharge or free end of the spout 14. The tube 60 communicates through a passage 62 (see FIG. 3) in the spout adapter 17 with an annular chamber 63, which is formed between a sealing ring 64, the sealing ring 51', the spout adapter 17, and the body 10.

Figure 4:
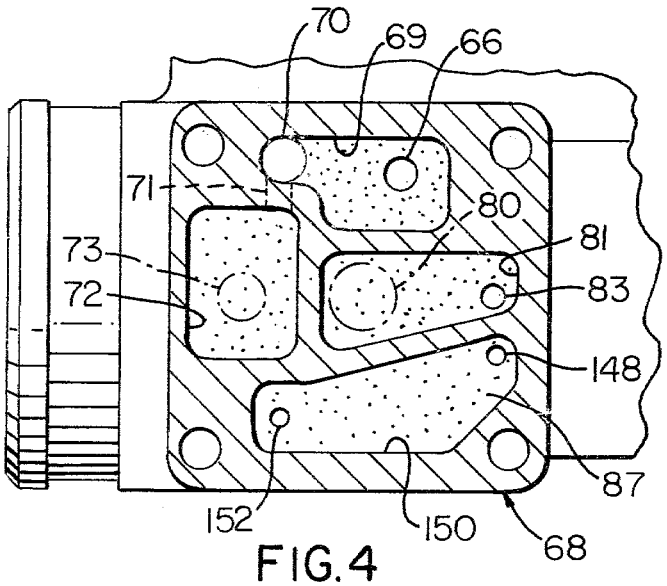
FIG. 4 is a plan view of a portion of the sensing arrangement of FIG. 3 showing the relationship of various ports and passages and taken substantially along line 4—4 of FIG. 3 with passages beyond the line 4—4 being shown in phantom.

The annular chamber 63 communicates through a passage 66 in the body 10 and an opening in a seal or gasket 67, which is disposed between the body 10 and a body 68, with a chamber 69 (see FIG. 4) in the body 68. The chamber 69 has a port 70 at one end communicating through a passage 71 in the body 68 with a chamber 72 in the body 68. The chamber 72 communicates through a passage 73 (see FIG. 3 and shown in phantom in FIG. 4) in a divider 74 of the body 68 with a chamber 75, which is formed between the divider 74 and a diaphragm 76. A cover or retainer 77 holds the diaphragm 76 on the body 68. Four bolts 78 (two shown) secure the retainer 77, the diaphragm 76, the body 68, and the seal 67 to the nozzle body 10.

The chamber 75 communicates through a passage 80 in the divider 74 with a chamber 81 in the body 68. The passage 80, which is shown in phantom in FIG. 4 to show its location in the chamber 81, is controlled by a poppet valve 82, which is responsive to the diaphragm 76.

The chamber 81 communicates with the annular chamber 51 through an opening in the seal or gasket 67 and a passage 83 in the body 10. Accordingly, as long as the poppet valve 82 is open, a poppet valve 84, which controls the passage 73, is open, and the opening 61 (see FIG. 1) is not closed due to the liquid within the tank reaching a predetermined level that indicates that the tank is filled, the venturi effect created by the flow of the liquid through the passages 40 (see FIG. 3) and 41 in the seat ring 26 draws air through the tube 60 to create a partial vacuum within the chamber 59. However, as soon as the opening 61 (see FIG. 1) is blocked or the valve 82 (see FIG. 3) or 84 is closed, the chamber 59 has its pressure reduced due to the air therein being withdrawn thereform because of the venturi effect in the third passage 43 due to the liquid flowing through the passages 40 and 41 whereby the diaphragm 56 moves upwardly since the partial vacuum in the chamber 56 is increased.

In a manner similar to that shown and described in U.S. Pat. No. 3,823,752 to Lasater et al, the diaphragm 56 has a screw 85 extending therethrough and holding a cup washer 86 on the upper side of the diaphragm 56 and a washer 87, which is formed of plastic, on the bottom side thereof. The screw 86 extends through an opening in the cup washer 86 and an opening in washer 87.

The screw 85 has a latch holder 88 threadedly connected thereto and engaging the lower surface of the washer 87. The latch holder 88 includes a pair of oppositely disposed, inclined legs 89 and 90. The legs 89 and 90 have openings 91 and 92, respectively, in their lower ends to receive one end of each of links 93 and 94, respectively.

The link 93 has a pair of spaced curved fingers 95 (one shown) at its other end for cooperation with the bottom of a head 96 of a pin 97. The other end of the link 94 has a pair of spaced curved fingers 98 (one shown), which also cooperate with the bottom of the head 96 of the pin 97.

The pin 97 has a longitudinal, axial passage 99 extending therethrough and in which is disposed a longitudinally extending reduced portion 100 of the screw 85. Accordingly, the pin 97 is slidably mounted on the screw 85.

The pin 97 has its lower end threaded into a cooperating threaded recess 101 in a latch retaining pin 102. The latch pin 102 is disposed between three balls 103 (two shown), which are positioned within passages in a latch plunger 104. When the latch retaining pin 102 is in the position shown in FIG. 3, the balls 103 prevent downward movement of the plunger 104, which is slidably mounted within the body 10.

When the diaphragm 56 is moved upwardly due to the fuel in the tank reaching a predetermined level, the latch pin 102 is moved upwardly therewith. This is because the latch holder 88 moves with the diaphragm 56 due to its connection through the screw 85 and carries the links 93 and 94 therewith. The fingers 95 and 98 of the links 93 and 94, respectively, act on the bottom of the head 96 of the pin 97 to move it upwardly with the diaphragm 56. Since the pin 97 is connected to the latch retaining pin 102, the latch pin 102 moves upwardly with the diaphragm 56 when the tank is filled.

The upward movement of the latch retaining pin 102 disposes a tapered portion of the latch pin 102 between the balls 103 whereby the balls 103 may move inwardly to allow the plunger 104 to be moved downwardly against the force of its spring 105. The correlation between the tapered portion of the latch pin 102 and the latch plunger 104 is more specifically shown in U.S. Pat. No. 2,582,195 to Duerr.

The lower end of the plunger 104 is connected to the handle 22 (see FIG. 1) as more particularly shown and described in U.S. Pat. No. 3,817,285 to Wilder et al. Thus, when the diaphragm 56 (see FIG. 3) moves upwardly to pull the latch retaining pin 102 and release the latch plunger 104 from the balls 103, the force of the spring 20 (see FIG. 1) closes the main poppet valve 19 as more particularly shown and described in the aforesaid Wilder et.al patent.

A spring 108 (see FIG. 3), which is disposed between the cap 58 and the cup washer 86, exerts a force against the upper surface of the diaphragm 56 and determines, in conjunction with a spring 109, which is disposed between the latch holder 88 and the head 96 of the pin 97, the partial vacuum at which the diaphragm 56 moves upwardly. The spring 108 must not be stronger than the spring 109. The spring 109 limits the upward movement of the latch pin 102. Both of the springs 108 and 109 urge the latch pin 102 to return to the position shown in FIG. 3 after shut off has occurred. The springs 108 and 109 also keep the latch pin 102 in the position of FIG. 3 if the nozzle should be turned upside down.

The body 10 has a bellows 115 (see FIG. 1), which is formed of a gasoline resistant synthetic rubber or urethane, for example, secured thereto and extending from the outlet 13 of the body 10 towards the free or discharge end of the spout 14. The bellows 115 is disposed in spaced relation to the spout 14 to form an annular passage 116 therebetween.

The outer end of the bellows 115 has a sealing means 117 removably connected thereto in the manner more particularly shown and described in the copending patent application of Jack A. McMath for "Liquid Dispensing Nozzle Having Vapor Recovery Sealing Arrangement," Ser. No. 970,814, filed Dec. 18, 1978 and assigned to the same assignee as the assignee of this application. The sealing means 117 has a large central opening 118 to enable the sealing means 117 to slide along the spout 14.

The spout 14 has a pair of latch rings 119 and 120 thereon for engagement with a lip 121 (see FIG. 2) of the fill pipe 16 to hold the free end of the spout 14 within the fill pipe 16. The latch rings 119 and 120 are secured to the spout 14 by suitable means such as set screws, for example.

As more particularly shown and described in the copending patent application of Jack A. McMath for "Liquid Dispensing Nozzle Having A Sealing Arrangement For Vapor Return Means," Ser. No. 696,937 filed June 17, 1976, now abandoned, continuation Ser. No. 856,110, now abandoned filed Nov. 30, 1977, continuation Ser. No. 918,057 filed June 22, 1978, and assigned to the same assignee as the assignee of this application, a check valve 125 (see FIG. 1) blocks communication of the annular passage 116 with vapor return equipment. The check valve 125 includes a slidable cylindrical member 126, as more particularly shown and described in the aforesaid McMath application, Ser. No. 856,110, now abandoned. The slidable cylindrical member 126 has a skirt 127 with a cam surface 128 at its end for cooperation with an actuating ball 129 (see FIG. 3), which is supported in a bushing 130 in the body 10.

The annular passage 116 (see FIG. 1) communicates with the vapor return equipment through an annular passage 131 (see FIG. 3), which is formed between the outer surface of the spout 14 and the skirt 127 of the slidable cylindrical member 126. The annular passage 131 communicates with the vapor recovery equipment through a vapor return passage (not shown) in the body 10 as more particularly shown and described in the copending patent application of Jack A. McMath for "Automatic Shut-Off Nozzle Having Vapor Return Seal," Ser. No. 684,441, now abandoned, filed May 7, 1976 continution Ser. No. 856,108 filed Nov. 30, 1977, now abandoned, continuation Ser. No. 943,326 filed Sept. 18, 1978, now abandoned, continuation Ser. No. 059,970 filed July 23, 1979, and assigned to the same assignee as the assignee of this application.

Accordingly, when the spout 14 is disposed in the fill pipe opening 15 (see FIG. 2) so that the sealing means 117 engages the end of the fill pipe 16 to stop movement of the sealing means 117, the continued movement of the spout 14 into the fill pipe opening 15 causes the body 10 (see FIG. 1), which has the spout 14 attached thereto through the spout adapter 17, to move relative to the slidable cylindrical member 126. As a result, the ball 129 (see FIG. 3), which moves with the body 10 because of its disposition within the bushing 130, engages the cam surface 128 of the skirt 127 of the slidable cylindrical member 126. This engagement of the ball 129 with the cam surface 128 cams the ball 129 from the position of FIG. 3 to the position of FIG. 5.

Figure 5:
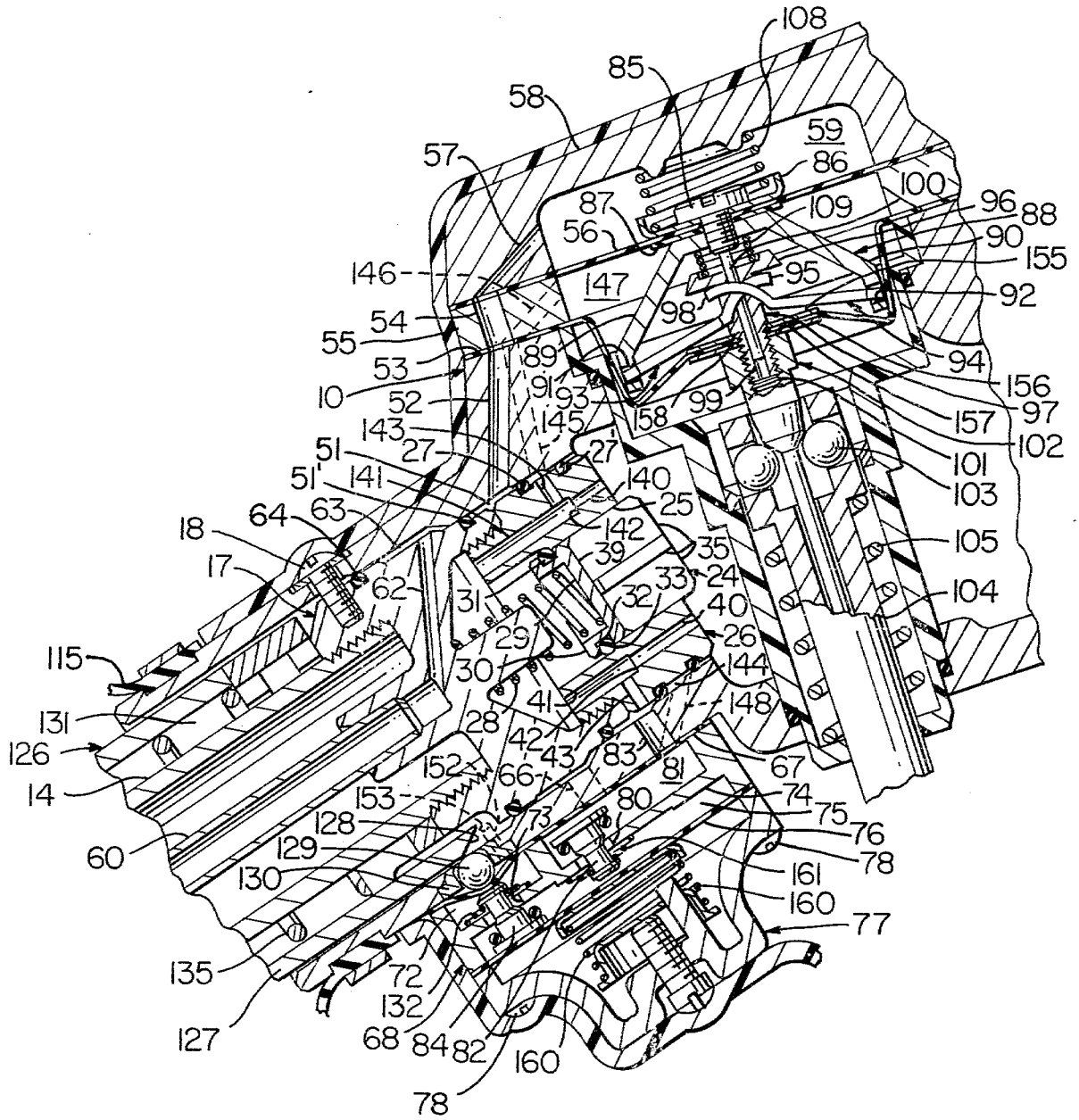
FIG. 5 is an enlarged fragmentary sectional view, similar to FIG. 3, of a portion of the nozzle of FIG. 1 and showing the sensing arrangement with activation being produced by the presence of liquid in the vapor return means at the predetermined location.

As shown in FIG. 5, the ball 129 acts through the seal or gasket 67 at one end of the poppet valve 84, which controls the passage 73 in the divider 74 in the body 68. A spring 132 continuously urges the poppet valve 84 to its closed position in which it blocks the passage 73. The spring 132 also urges the ball 129 into the interior of the nozzle body 10 so that the ball 129 cannot be moved out of the bushing 130 except by the cam surface 128.

Thus, when there is relative movement between the slidable cylindrical member 126 and the spout 14 due to the spout 14 being inserted in the fill pipe opening 15 (see FIG. 2) and the sealing means 117 abutting the end of the fill pipe 16 with sufficient force to effectively form a seal around the fill pipe opening 15, the poppet valve 84 (see FIG. 5) is moved to an open position through the actuating ball 129 acting on the end of the poppet valve 84 through the seal or gasket 67. The opening of the poppet valve 84 allows air to flow from the inlet opening 61 (see FIG. 1) in the spout 14 and through the vacuum tube 60, the passage 62 (see FIG. 5) in the spout adapter 17, the annular chamber 63, the passage 66 in the body 10, the opening (not shown) in the seal 67, the chamber 69 (see FIG. 4) in the body 68, the port 70, the passage 71 in the body 68, the chamber 72 in the body 68, the passage 73 (see FIG. 5) in the divider 74, the chamber 75, the passage 80 in the divider 74, the chamber 81, the opening in the seal 67, the passage 83 in the body 10, and the annular chamber 51 to the third passage 43 in the seat ring 26. This provides a supply of air so that the partial vacuum created in the chamber 59 by the venturi effect is not increased.

Accordingly, the slidable cylindrical member 126 of the check valve 125 (see FIG. 1) allows liquid flow through the body 10 only if the sealing means 117 (see FIG. 2) is in sealing engagement with the end of the fill pipe 16 when the spout 14 is inserted into the fill pipe opening 15 to supply the liquid thereto. If there is not engagement of the sealing means 117 with the end of the fill pipe 16 with sufficient force to form a seal around the fill pipe opening 15, then there will not be the desired relative motion of the spout 14, the spout adapter 17, and the body 10 with respect to the slidable cylindrical member 126. This prevents the poppet valve 84 (see FIG. 3) from being opened so that air is not supplied to the third passage 43 in the seat ring 26. This lack of air to the third passage 43 in the seat ring 26 causes the partial vacuum in the chamber 59 to increase to close the main poppet valve 19 (see FIG. 1) so that liquid cannot flow through the body 10 and the spout 14.

It should be understood that the main poppet valve 19 must be opened and flow to occur for the partial vacuum to be reduced in the chamber 59. However, only a small amount of liquid will flow through the spout 14 before the poppet valve 19 is automatically closed by the increased partial vacuum in the chamber 59. This is because the poppet valve 84 (see FIG. 3) always is closed unless the sealing means 117 (see FIG. 2) is engaging the end of the fill pipe 16 with sufficient force to effectively form a seal around the fill pipe opening 15 and the spout 14 has been inserted into the fill pipe opening 15 a sufficient distance to produce the necessary relative motion to cause the poppet valve 84 (see FIG. 3) to be opened.

Therefore, the poppet valve 84 is closed unless necessary relative motion has occurred. As a result of the poppet valve 84 being closed, opening of the main poppet valve 19 (see FIG. 1) to produce the necessary flow past the third passage 43 (see FIG. 3) in the seat ring 26 to produce the partial vacuum in the chamber 59 automatically increases the partial vacuum in the chamber 59 whereby the main poppet valve 19 (see FIG. 1) is automatically closed shortly after being opened.

When the spout 14 is removed from the fill pipe opening 15 (see FIG. 2) so that the sealing means 117 does not engage the end of the fill pipe 16, a return spring 135 (see FIG. 1) produces the relative motion of the spout 14, the spout adapter 17, and the body 10 with respect to the slidable cylindrical member 126. Thus, the slidable cylindrical member 126 moves relative to the actuating ball 129 (see FIG. 3) so that the cam surface 128 on the skirt 127 of the slidable cylindrical member 126 no longer engages the ball 129 whereby the ball 129 partially returns into the interior of the body 10. When this occurs, the poppet valve 84 is moved to its closed position by the spring 132. Closing of the poppet valve 84 stops air flow through the vacuum tube 60 to the chamber 59 so that the second diaphragm 56 is caused to move upwardly to release the latch plunger 104 from the balls 103 whereby the spring 20 (see FIG. 1) closes the main poppet valve 19 to automatically stop flow of liquid through the body 10 if it has not been stopped by the manually operated handle 22.

The seat ring 26 (see FIG. 3) has a fourth passage 140 having one end communicating with the chamber 12 within the interior of the body 10 and its other end communicating with one end of a fifth passage 141 in the seat ring 26. The other end of the fifth passage 141 communicates with the downstream sides of the seat ring 26 and the by-pass valve 24.

The fourth passage 140 has a smaller diameter than the fifth passage 141 to form a shoulder 142 at the junction of the fourth passage 140 and the fifth passage 141. The seat ring 26 has a sixth passage 143, which has its axis substantially perpendicular to the axis of the passages 140 and 141 and has a slightly smaller diameter than the fourth passage 140, communicating with the fifth passage 141 and an annular chamber 144, which is formed between the body 10, the seat ring 26, and the sealing rings 27 and 27'.

As the liquid flows through the fourth passage 140 and the fifth passage 141, a venturi effect is created in the sixth passage 143. This is because the increase in the cross sectional area of the fifth passage 141 compared with the cross sectional area of the fourth passage 140 produces an expansion of the liquid to reduce its velocity whereby air is drawn from the sixth passage 143 into the fifth passage 141. The sixth passage 143 communicates through the annular chamber 144, a passage 145 in the body 10, an opening (not shown) in the diaphragm 53, and a passage 146 in the spacer 55 to a chamber 147. The chamber 147 is formed between the diaphragms 53 and 56 and the inner surface of the spacer 55.

The annular chamber 144 also communicates through a passage 148 in the body 10 and an opening (not shown) in the seal 67 with a chamber 150 (see FIG. 4) within the body 68. The chamber 150 communicates through an opening (not shown) in the seal 67 (see FIG. 3) with a passage 152 in the body 10. The passage 152 terminates in a port 153, which is in the inner surface of the body 10 and communciates with the annular passage 131. The inner passage 131 is part of the vapor return means of the body 10.

Thus, when the sealing means 117 (see FIG. 2) is in sealing engagement with the fill pipe 16 so that the check valve 125 is not effective, the chamber 144 (see FIG. 3) communicates with the tank being filled. Thus, air for the third passage 143 is drawn from the tank being filled.

Therefore, as long as the port 153 is not blocked by liquid due to gasoline flowing from the tank being filled through the annular passage 116 (see FIG. 1) and the annular passage 131 (see FIG. 3) to the vapor recovery equipment, the venturi effect created by the flow of liquid through the passages 140 and 141 draws air from the tank being filled to create a partial vacuum within the chamber 147. However, as soon as the port 153 is blocked by liquid, the chamber 147 has its pressure reduced due to the air therein being withdrawn because of the venturi effect in the sixth passage 143 due to the liquid flowing through the passages 140 and 141 whereby the diaphragm 53 moves upwardly since the partial vacuum in the chamber 147 is increased.

The diaphragm 53 is secured between a pair of washers 155 and 156, which are mounted between an upper surface 157 of the latch retaining pin 102 and a lower surface 158 of the pin 97. Thus, movement of the diaphragm 53 in an upward direction is transmitted to the latch retaining pin 102. This upward movement of the latch retaining pin 102 results in the main poppet valve 19 (see FIG. 1) being closed in the manner previously described when the latch retaining pin 102 (see FIG. 3) is moved upwardly by the diaphragm 56 moving upwardly.

When the diaphragm 53 moves upwardly to move the latch retaining pin 102 upwardly, the links 93 and 94 are pivoted to the position of FIG. 5, and the spring 109 is compressed. However, there is no motion of the diaphragm 56 because the latch holder 88 does not move because the links 93 and 94 are pivoted as shown in FIG. 5.

Thus, each of the diaphragms 53 and 56 produces separate movement in the same direction of the latch retaining pin 102. While the upward movement of the upper diaphragm 56 causes the lower diaphragm 53 to move with the latch retaining pin 102, it is only the movement of the upper diaphragm 56, due to the level of the liquid in the tank being filled reaching a predetermined level or the pressure in the tank exceeding a predetermined pressure. that produces the upward movement of the latch retaining pin 102.

While the increase in the partial vacuum in the chamber 147 might tend to cause the upper diaphragm 56 to move downwardly slightly, this will not have any effect on the upward movement of the latch retaining pin 102 by the lower diaphragm 53. This is because the links 93 and 94 pivot against the force of the spring 109 to enable the latch retaining pin 102 to be raised upwardly by the upward movement of the lower diaphragm 53.

Considering the operation of the present invention, the poppet valve 82 (see FIG. 3) is normally in an open position. With the valve 82 open and the spout 14 disposed in the fill pipe opening 15 (see FIG. 2) so that the poppet valve 84 has been moved to its open position of FIG. 5 due to the sealing means 117 (see FIG. 2) sealing against the fill pipe 16, opening of the main poppet valve 19 (see FIG. 1) by the handle 22 causes liquid to flow from the inlet 11 to the chamber 12. This causes the bypass valve 24 (see FIG. 3) to be moved to an open position to allow flow through the passage 25 in the seat ring 26. Liquid flows from the passage 25 in the seat ring 26 through the spout adapter 17 into the spout 14 from which it flows to the tank being filled.

Liquid also flows through the passages 40 and 41 in the seat ring 26 to produce the venturi effect whereby air is drawn into the third passage 43 from the annular chamber 51. The chamber 51 draws air from the tank being filled through the opening 61 (see FIG. 1) in the spout 14 as long as the opening 61 is not blocked and the poppet valves 82 (see FIG. 5) and 84 are open. When the opening 61 (see FIG. 1) is blocked by the level of the liquid in the tank being filled reaching a level at which it blocks the opening 61, air can no longer be drawn through the openin 61 so that air is withdrawn from the chamber 59. This removal of air from the chamber 59 increases the partial vacuum in the chamber 59 and causes the main poppet valve 19 (see FIG. 1) to be automatically closed because of the upper diaphragm 56 (see FIG. 3) moving upwardly to cause the latch retaining pin 102 to move upwardly therewith and enable the spring 20 (see FIG. 1) to close the poppet valve 19 as more particularly shown and described in the aforesaid Wilder et al patent.

Liquid also flows through the passages 140 (see FIG. 3) and 141 to produce a venturi effect whereby air is drawn into the sixth passage 143 from the annular chamber 144. The chamber 144 draws air from the tank being filled through the annular passage 116 (see FIG. 1), the annular passage 131 (see FIG. 3), the port 153 in the body 10, the passage 152 in the body 10, (see FIG. 4), the chamber 150 within the body 68, and the passage 148 (see FIG. 3) in the body 10 as long as the port 153 is not blocked by liquid. When the port 153 is blocked by liquid, air can no longer be drawn from the tank so that air is withdrawn from the chamber 147.

This removal of air from the chamber 147 increases the partial vacuum therein to cause the lower diaphragm 53 (see FIG. 5) to move upwardly to cause the latch retaining pin 102 to move upwardly therewith. This enables the spring 20 (see FIG. 1) to close the main poppet valve 19 as more particularly shown and described in the aforesaid Wilder et al patent.

The poppet valve 82 (see FIG. 3) is moved to its closed position when the pressure in the tank exceeds a predetermined pressure. This is due to the diaphragm 76 being moved against the force of an adjustable spring 160, which is more particularly shown and described in the copending patent application of Jack Alan McMath for "Automatic Shut-Off Nozzle Having An Arrangement For Controlling When Automatic Shut Off Occurs In Response To Pressure In A Sealed Tank," Ser. No. 917,911, filed June 22, 1978, now abandoned, and assigned to the same assignee as the assignee of this application, by the pressure in the tank being filled to permit the poppet valve 82 to be moved to its closed position in response to the action of a spring 161.

While the present invention has shown and described the latch holder 88 as being utilized to provide the connecting arrangement of the upper diaphragm 56 to the latch retaining pin 102 and the lower diaphragm 53 being secured to the same connecting arrangement, it should be understood that any other suitable connecting means may be employed in which the latch retaining pin 102 will respond to the upward movement of either of the diaphragms 53 and 56. For example, the connecting arrangement in U.S. Pat. No. 3,835,899 to Holder could be employed.

An advantage of this invention is that separate and independent mechanisms are employed for automatically stopping flow in a liquid nozzle with each being responsive to different conditions. Another advantage of this invention is that a customer is not charged for gasoline which is not retained in the vehicle tank but is returned to the supply tank through the vapor recovery arrangement. A further advantage of this invention is that gasoline cannot flow from the vehicle tank being supplied to the supply tank through the vapor recovery arrangement.

For purposes of exemplification, a particular embodiment of the invention has been shown and described according to the best present understanding thereof.

However, it will be apparent that changes and modifications in the arrangement and construction of the parts thereof may be resorted to without departing from the spirit and scope of the invention.

What is claimed is:

1. In an automatic shut-off nozzle comprising a body having an inlet and an outlet, a valve in said body controlling flow of liquid from said inlet to said outlet, means controlling the operation of said valve, spout means communicating with said outlet and having its free end for disposition in an opening of a fill pipe of a vehicle tank or the like, means to return vapor from the tank being filled, sealing means to form a seal between the fill pipe opening and said vapor return means when said spout means is disposed in the fill pipe, first means to cause said controlling means to be activated to move said valve to its closed position in response to at least one of two conditions existing in the tank, the conditions being build-up of vapor pressure to a predetermined vapor pressure and liquid reaching a predetermined level in the tank, the improvement comprising:

second means, independent and separate of said first means, to cause automatic activation of said controlling means to move said valve to its closed position in response to the presence of liquid in said vapor return means.

2. The improvement according to claim 1 in which said controlling means includes manual operated means controlling the operation of said valve and release means to release said manual operated means to allow closing of said valve and stoppage of liquid flow; said first means includes a chamber, flexible means forming a wall of said chamber, communicating means communicating said chamber with the tank being filled, means to create a partial vacuum in said chamber when liquid is flowing through said body, means to block said communicating means when at least one of the two conditions exists in the tank, the blocking of said communicating means increasing the partial vacuum in said chamber when said valve is open to move said flexible means, and means to transmit movement of said flexible means to said release means to move said release means to release said manual operated means to close said valve; and said second means includes a chamber, flexible means forming a wall of said chamber, communicating means communicating said chamber of said second means with the tank being filled through said vapor return means, means to create a partial vacuum in said chamber of said second means when liquid is flowing through said body, the presence of liquid in said vapor return means blocking said communicating means to increase the partial vacuum in said chamber of said second means when said valve is open to move said flexible means of said second means, and means to transmit movement of said flexible means of said second means to said release means to move said release means to release said manual operated means to close said valve.

3. The improvement according to claim 2 in which each of said flexible means of said first means and said flexible means of said second means moves in the same direction to cause movement of said release means.

4. The improvement according to claim 3 in which said transmitting means of said first means includes means connecting said flexible means of said first means to said release means and said transmitting means of said second means includes means connecting said flexible means of said second means to said release means.

5. The improvement according to claim 4 in which said flexible means of said first means forms a wall of said chamber of said second means.

6. The improvement according to claim 5 in which said transmitting means of said second means includes means to cause movement of said release means without causing movement of said flexible means of said first means.

7. The improvement according to claim 4 in which said transmitting means of said second means includes means to cause movement of said release means without causing movement of said flexible means of said first means.

8. The improvement according to claim 3 in which said flexible means of said first means forms a wall of said chamber of said second means.

9. The improvement according to claim 8 in which said transmitting means of said second means includes means to cause movement of said release means without causing movement of said flexible means of said first means.

10. The improvement according to claim 3 in which said transmitting means of said second means includes means to cause movement of said release means without causing movement of said flexible means of said first means.

11. The improvement according to claim 2 in which said flexible means of said first means forms a wall of said chamber of said second means.

12. The improvement according to claim 11 in which said transmitting means of said second means includes means to cause movement of said release means without causing movement of said flexible means of said first means.

13. The improvement according to claim 2 in which said transmitting means of said second means includes means to cause movement of said release means without causing movement of said flexible means of said first means.

14. The improvement according to claim 2 in which said transmitting means of said first means includes means connecting said flexible means of said first means to said release means and said transmitting means of said second means includes means connecting said flexible means of said second means to said release means.

15. The improvement according to claim 1 in which said controlling means includes manual operated means controlling the operation of the said valve and release means to release said manual operated means to allow closing of said valve and stoppage of liquid flow; said first means includes means responsive to the existence of at least one of the two conditions in the tank and connected to said release means to move said release means to release said manual operated means to close said valve; and said second means includes means responsive to the presence of liquid in said vapor return means and connected to said release means to move said release means to release said manual operated means to close said valve.

16. The improvement according to claim 1 in which said first means is responsive to either of the two conditions existing in the tank.

17. The improvement according to claim 1 in which said controlling means includes manual operated means controlling the operation of said valve and release means to release said manual operated means to allow closing of said valve and stoppage of liquid flow; said first means includes a chamber, means to create a partial vacuum in said chamber when liquid is flowing through said body, the partial vacuum in said chamber increasing when said valve is open and at least one of the two conditions exists in the tank, and means responsive to the increase in the partial vacuum in said chamber to move said release means to release said manual operated means to close said valve; and said second means includes a chamber, means to create a partial vacuum in said chamber of said second means when liquid is flowing through said body, the partial vacuum in said chamber of said second means increasing when said valve is open and liquid is present in said vapor return means, and means responsive to the increase in the partial vacuum in said chamber of said second means to move said release means to release said manual operated means to close said valve.

18. The improvement according to claim 17 in which each of said responsive means of said first means and said responsive means of said second means moves in the same direction to cause movement of said release means.

19. The improvement according to claim 1 in which said first means includes flexible means movable in response to at least one of the two conditions existing in the tank to move said controlling means to move said valve to its closed position, and said second means includes flexible means, separate from said flexible means of said first means, movable in response to the presence of liquid in said vapor return means to move said controlling means to move said valve to its closed position.

20. The improvement according to claim 19 in which each of said flexible means of said first means and said flexible means of said second means moves in the same direction to cause movement of said controlling means.

21. The improvement according to claim 15 in which said first means is responsive to either of the two conditions existing in the tank.

22. In an automatic shut-off nozzle comprising a body having an inlet and an outlet, a valve in said body controlling flow of liquid from said inlet to said outlet, means controlling the operation of said valve, spout means communicating with said outlet and having its free end for disposition in an opening of a fill pipe of a vehicle tank or the like, means to return vapor from the tank being filled, sealing means to form a seal between the fill pipe opening and said vapor return means when said spout means in disposed in the fill pipe, first means connected to said controlling means to cause said controlling means to be activated to move said valve to its closed position in response to at least one of two conditions existing in the tank, the conditions being build-up of vapor pressure to a predetermined vapor pressure and liquid reaching a predetermined level in the tank, the improvement comprising:

second means, independent and separate of said first means, connected to said controlling means to cause activation of said controlling means to move said valve to its closed position in response to the presence of liquid in said vapor return means.

* * * * *